US008576131B2

(12) United States Patent
Szopko et al.

(10) Patent No.: US 8,576,131 B2
(45) Date of Patent: Nov. 5, 2013

(54) HELICAL ANTENNA APPARATUS AND METHOD OF FORMING HELICAL ANTENNA

(75) Inventors: Robert Scott Szopko, Downers Grove, IL (US); Michael Joseph Alwicker, Chicago, IL (US); Adem Celebi, Oak Park, IL (US); Mark Allen Kenkel, Schaumburg, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 415 days.

(21) Appl. No.: 12/976,314

(22) Filed: Dec. 22, 2010

(65) Prior Publication Data

US 2012/0163635 A1 Jun. 28, 2012

(51) Int. Cl.
*H01Q 1/00* (2006.01)

(52) U.S. Cl.
USPC ..... 343/720

(58) Field of Classification Search
USPC ..... 343/895, 700 MS, 702, 720
See application file for complete search history.

(56) References Cited

U.S. PATENT DOCUMENTS

| | | | | |
|---|---|---|---|---|
| 4,442,438 | A | 4/1984 | Siwiak et al. | |
| 5,977,931 | A | 11/1999 | Openlander | |
| 7,245,268 | B2 | 7/2007 | O'Neill et al. | |
| 7,301,506 | B2 * | 11/2007 | Kenkel et al. | 343/895 |
| 2003/0118204 | A1 * | 6/2003 | Kawasaki et al. | 381/355 |
| 2003/0160727 | A1 * | 8/2003 | Ebine et al. | 343/702 |
| 2003/0220005 | A1 * | 11/2003 | Kedzierski | 439/173 |
| 2006/0022891 | A1 | 2/2006 | O'Neill et al. | |
| 2006/0176237 | A1 * | 8/2006 | Kenkel et al. | 343/895 |
| 2008/0014927 | A1 * | 1/2008 | Bondyopadhyay | 455/427 |
| 2012/0026051 | A1 * | 2/2012 | Nilsson | 343/752 |

FOREIGN PATENT DOCUMENTS

| | | |
|---|---|---|
| JP | 878945 | 3/1996 |

* cited by examiner

*Primary Examiner* — Daniel Hess
*Assistant Examiner* — Steven J Malone
(74) *Attorney, Agent, or Firm* — Banner & Witcoff, Ltd.

(57) ABSTRACT

An antenna assembly and method of forming an antenna is disclosed. The antenna comprises a dielectric core wrapped with an antenna tape having a conductive portion. A printed circuit board extends from a chassis, and a ground element secures the printed circuit board to the chassis at a point located away from the chassis. The printed circuit board can be secured to the conductive portion on the tape through a wire or flex cable connection. The dielectric core can be formed of a shock absorbing material and is configured to extend into the chassis. The antenna assembly can be provided with an antenna cover placed over the dielectric core and a shock-absorbing material can be located between the dielectric core and the antenna cover.

33 Claims, 4 Drawing Sheets

HELICAL ANTENNA APPARATUS AND METHOD OF FORMING HELICAL ANTENNA

TECHNICAL FIELD

The disclosure herein relates to the field of small broadband antennas, and more particularly to helical antennas that may be used with wireless microphones that transmit in the UHF band range.

BACKGROUND

It may be desirable to implement a small, robust, and inexpensive antenna that is easy to assemble in one or more of various wireless applications such as wireless microphones, computers, mobile devices, and other wireless transmission devices.

U.S. Pat. No. 7,301,506 to Kenkel et al. ("Kenkel"), which is incorporated herein fully by reference, discloses one such example. Kenkel discloses a helical antenna assembly formed by taking a non-metallic tape and placing a metallic tape strip diagonally onto the non-metallic tape. A dielectric core is then wrapped with the tape. An electrical connector and a central conductor that is located in the center of the dielectric core contact the metallic tape strip. One or two tabs on the tape are bent over the ends of the dielectric core to prevent the tape assembly from separating from the dielectric core. Eyelets are also affixed to the center conductor to pin the tabs. The pitch and width of the conductive portion of the tape assembly can be altered to obtain the desired electrical characteristics when the tape assembly is wrapped around the dielectric core.

BRIEF SUMMARY

In one exemplary embodiment, the present disclosure contemplates an antenna assembly comprising a dielectric core with antenna tape having a conductive portion wrapped around the dielectric core, and a printed circuit board that may extend from a chassis. The printed circuit board and the conductive portion on the tape can be electrically coupled.

In another exemplary embodiment, the present disclosure contemplates a wireless microphone assembly comprising a sound capsule, a chassis, and an antenna assembly connected to the chassis. The antenna assembly comprises a dielectric core which extends into the chassis. An antenna tape comprising a conductive portion is wrapped around the dielectric core. A printed circuit board may extend from the chassis, and at least a portion of the printed circuit board is located in the chassis. The printed circuit board and the conductive portion on the tape are electrically coupled.

In another exemplary embodiment, the present disclosure contemplates a method for forming an antenna comprising wrapping an antenna tape comprising a conductive portion around the dielectric core, mounting a printed circuit board to a chassis at a point located away from the chassis, and electrically coupling the printed circuit board and the conductive portion.

Other objects and features of the invention will become apparent by reference to the following description and drawings.

BRIEF DESCRIPTION OF THE DRAWINGS

The present disclosure is illustrated by way of example and not limited in the accompanying figures.

DETAILED DESCRIPTION OF THE INVENTION

In the following description of various example structures in accordance with the present disclosure, reference is made to the accompanying drawings, which form a part hereof, and in which are shown by way of illustration of various structures in accordance with the invention recited in the claims. Additionally, it is to be understood that other specific arrangements of parts and structures may be utilized and structural and functional modifications may be made without departing from the scope of the present disclosure. Also, while the terms "top" and "bottom" and the like may be used in this specification to describe various example features and elements of the disclosure, these terms are used herein as a matter of convenience, e.g., based on the example orientations shown in the FIGS. and/or the orientations in typical use. Nothing in this specification should be construed as requiring a specific three dimensional or spatial orientation of structures in order to fall within the scope of the claims.

Figure 1:
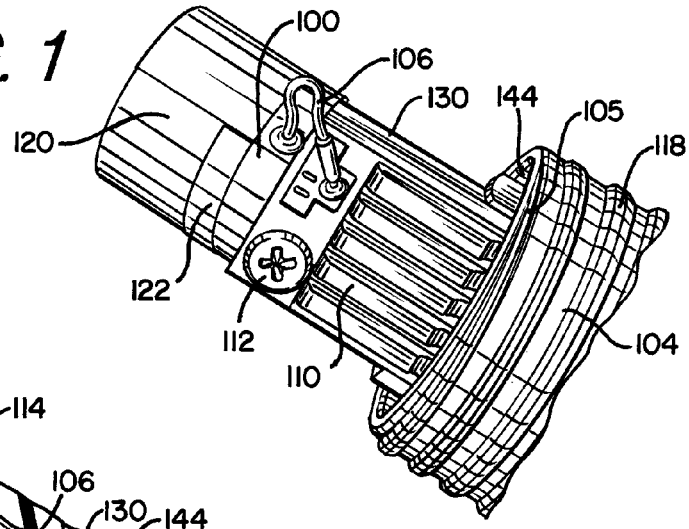
FIG. 1 shows a perspective side view of an exemplary antenna assembly.
Figure 2:
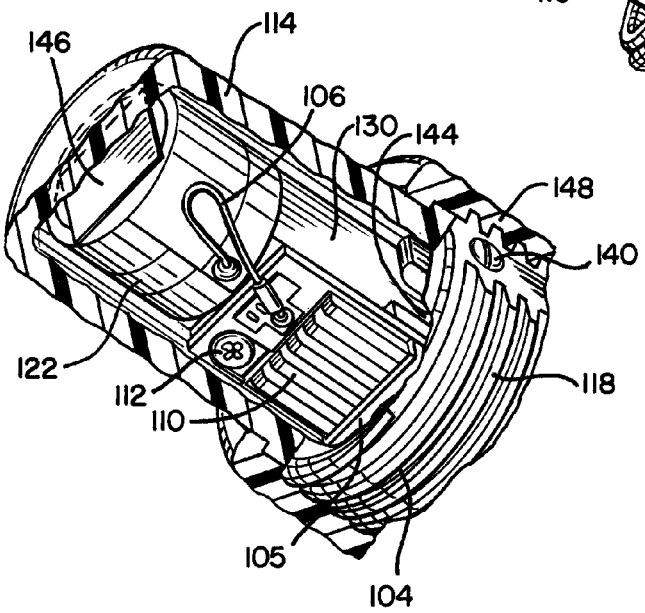
FIG. 2 shows a perspective side view of the antenna assembly of FIG. 1 with the addition of an antenna cover.

FIGS. 1 and 2 generally depict an antenna 100 having a dielectric core 130 with an antenna wrap or tape 120, a printed circuit board ("PCB") 110, and an antenna cover 114. The antenna 100 is secured to a chassis 104 of a handheld microphone. The handheld microphone can include a wireless transmitter for wireless transmission. The microphone generally has a transducer element or sound capsule for receiving sound input. The transducer element can be dynamic, condenser, ribbon, or any other known transducer element.

A conductive element such as a coupling wire 106 or flex cable (not shown) may electrically couple a conductive portion 122 of the antenna tape 120 to the PCB 110, which acts as a strain relief connection interface between the two components. A ground element, which can be a screw 112, may be used to connect the PCB 110 to the chassis 104 near the wire 106 to allow for a proper ground reference.

The dielectric core 130 can mount near the PCB 110 and in the chassis 104. The PCB 110 extends past a chassis wall 105 and into an opening 144 of a handheld microphone. Additionally, a shock absorbing member 146 comprising a small piece of shock absorbing foam can be placed between the inside area of the antenna cover 114 and the end of the dielectric core 130 to provide additional shock absorption capability to absorb shock energy during drop impact if the antenna is mishandled. In one exemplary embodiment, the shock absorbing member 146 can be formed of a poron pad. The coupling wire 106 provides strain relief between the PCB 110 and the antenna 100. In particular, the coupling wire 106 can be provided with extra length so as to provide additional slack in the wire such that it can freely move during drop impact without being severed. This enhances the shock absorption capabilities of the antenna 100 if it is dropped or mishandled, or if the antenna 100 is otherwise moved relative to the PCB 110.

In order to properly feed the antenna 100, the radio frequency ("RF") signal needs to be properly referenced to a ground. The ground screw 112 can be added between the chassis 104 and the PCB 110 to act as the ground reference.

Figure 3:
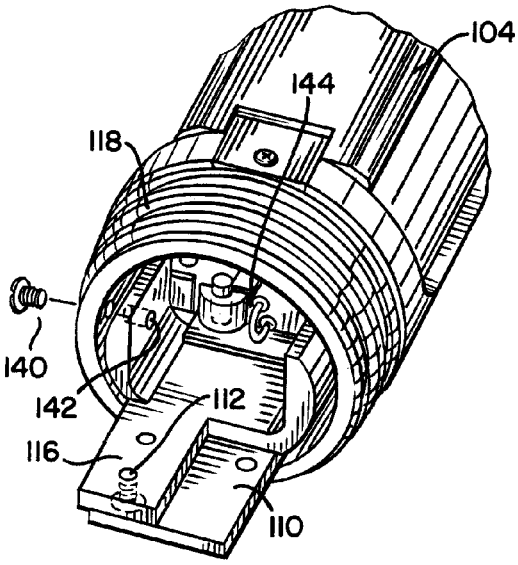
FIG. 3 shows a perspective top view of the antenna assembly of FIG. 1 with the dielectric core and antenna cover removed.
Figure 4:
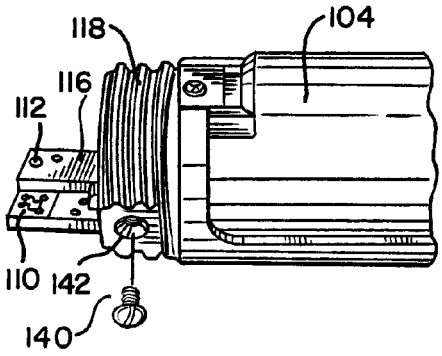
FIG. 4 shows another perspective side view of the antenna assembly of FIG. 1 with the dielectric core and antenna cover removed.

As shown in FIGS. 3 and 4, the chassis 104 is provided with an L-shaped tab or flange 116 that extends from the chassis 104 for retaining the PCB 110. The PCB 110 is secured to the tab 116 by ground screw 112 at a point away from the chassis 104. This allows the PCB 110 to extend further out of the chassis 104 of the microphone and to provide a shorter distance between the antenna 100 and the PCB 110, which ultimately provides a better RF transmission to the antenna 100. Additionally, the chassis 104 can be provided with threads 118 for receiving mating threads on a sleeve 148 which serves as an external handle or grip on the wireless microphone, and may also serve as an exterior housing covering batteries for operating the microphone. One or more screws 140 align with screw holes 142 to maintain the antenna cover 114 and the dielectric core 130 in place on the chassis 104. However, other methods for securing the antenna cover 114 to the chassis 104 are also contemplated.

Figure 5:
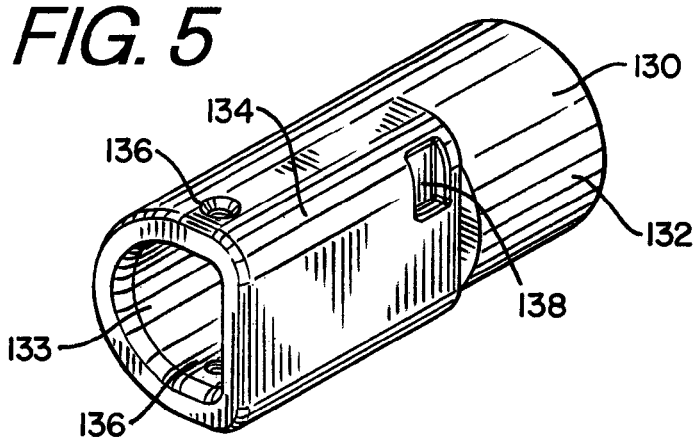
FIG. 5 shows a perspective view of an exemplary dielectric core.
Figure 6:
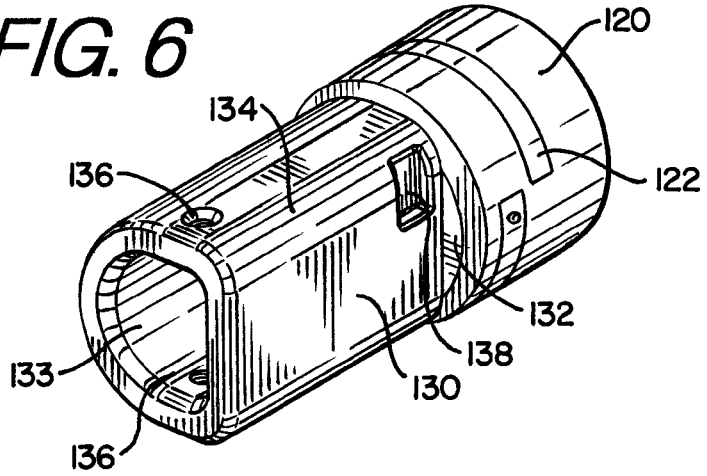
FIG. 6 shows a perspective view of the dielectric core of FIG. 5 wrapped with antenna tape.

FIGS. 5 and 6 generally depict one embodiment of a dielectric core 130. FIG. 5 shows the dielectric core 130 prior to being wrapped with antenna tape 120, and FIG. 6 shows the dielectric core 130 after being wrapped with antenna tape 120. The dielectric core 130 is not rigid and helps absorb drop stress to protect the PCB 110 and the electrical contacts in the antenna 100. A suitable material for forming the dielectric core 130 is Thermoplastic Urethane ("TPU"), which provides good absorption of shock energy during drop impact of the antenna 100.

The dielectric core 130 has a first cylindrical portion 132 and a second elongated portion 134. The first cylindrical portion 132 is configured to receive the antenna tape 120, and the second elongated portion 134 is configured to be inserted into the chassis 104 of the microphone. The first cylindrical portion 132 may have a circular cross section for receiving the antenna tape 100. The second elongated portion 134 may have a D-shaped cross section or a partially curved profile with a flat surface for interfacing with the L-shaped tab 116 of the chassis 104 and the PCB 110 such that the dielectric core 130 does not interfere with the PCB 110 during assembly. In particular, the D-shaped profile corresponds to the inside profile of the chassis 104 formed by the opening 144 in the chassis 104, the tab 116, and the PCB 110, and allows the dielectric core 130 to be placed in the chassis 104 around the tab 116 and PCB 110. The addition of the second elongated portion 134 provides good shock absorption properties to the antenna 100. The second elongated portion 134 also has an opening 133 which may extend throughout the length of the second elongated portion 134, and to the first cylindrical portion 132. The second elongated portion 134 is also provided with two holes 136 for securing the dielectric core 130 and the antenna cover 114 to the chassis 104 via one or more screws 140. A notch 138 in the second elongated portion 134 provides a recess which provides clearance between an end of the ground screw 112 and the dielectric core 130. This permits the ground screw 112 to fully extend past the tab 116 of the chassis 104 without contacting the dielectric core 130, such that the screw 112 does not impact the positioning of the dielectric core 130 relative to the PCB 110. The two holes 136 can be formed suitable for mating to screws 140, which can be self tapping (shown in FIG. 3). This provides a low cost mating mechanical connection interface to the chassis 104.

Figure 5A:
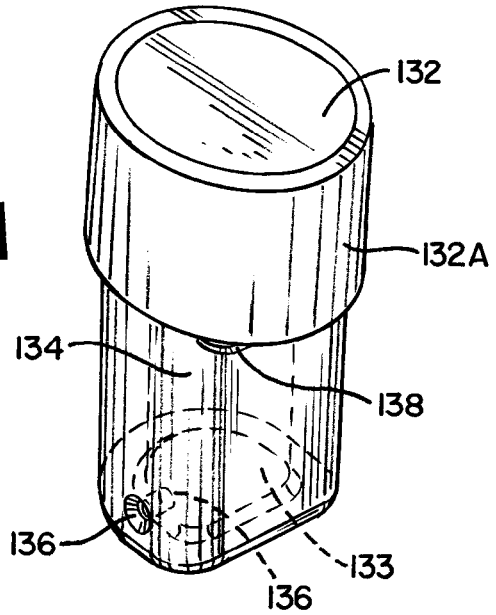
FIG. 5A shows a perspective view of another exemplary dielectric core.

Additionally, the dielectric core 130 can be modified into other shapes and configurations. For example, as shown in FIG. 5A, the first portion 132A can be formed into to an elliptical shape to account for other required mechanical features.

Figure 7A:
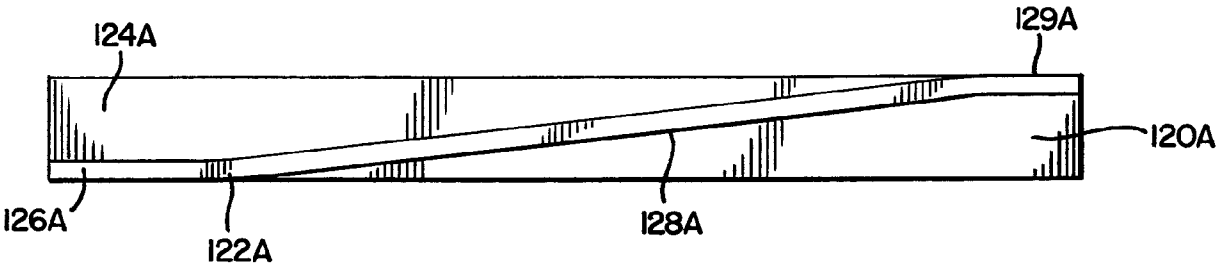
FIGS. 7A-7C show exemplary antenna tape configurations.
Figure 7B:
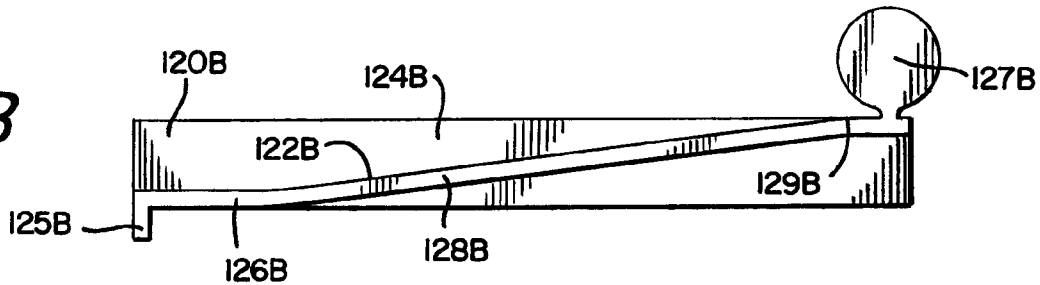
Figure 7C:
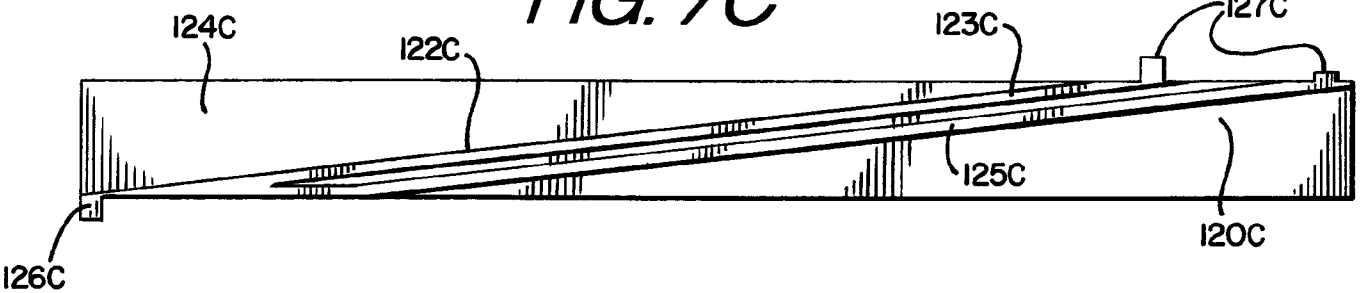
Figure 8A:
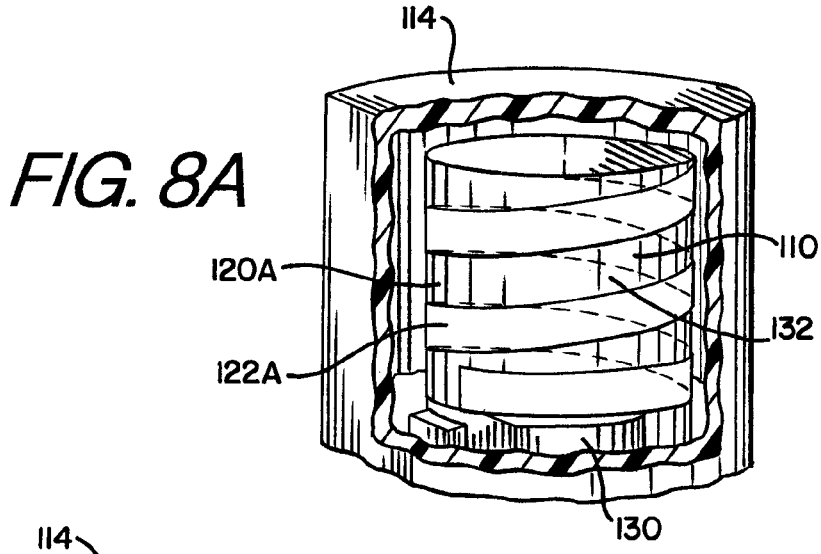
FIG. 8A-8C show the exemplary antenna tape configurations of FIGS. 7A-7C wrapped around a dielectric core.
Figure 8B:
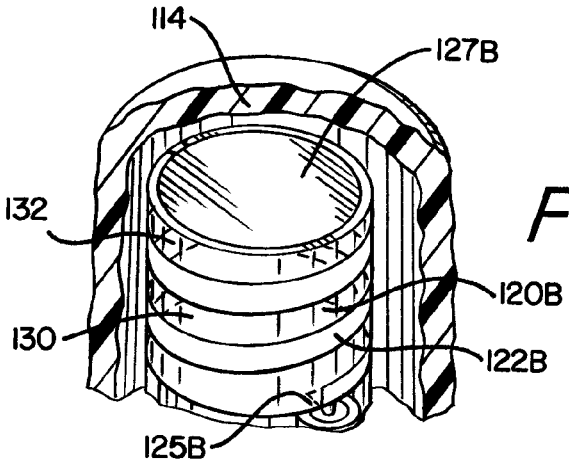
Figure 8C:
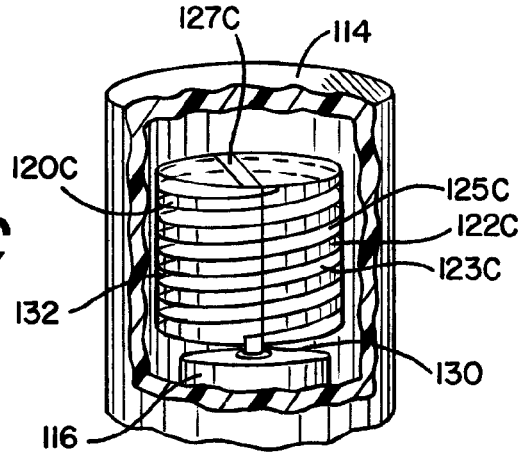

FIGS. 7A-7C depict antenna tapes 120A, 120B, 120C that may be used in conjunction with the antenna 100 and the dielectric core 130. FIGS. 8A-8C respectively show the antenna tapes of FIGS. 7A-7C wrapped around the dielectric core 130.

As shown in FIGS. 7A-7C, the antenna tapes 120A, 120B, 120C can comprise conductive portions 122A, 122B, 122C and substrate portions 124A, 124B, 124C. The conductive portions 122A, 122B, 122C can be formed of copper foil and the substrate portions 124A, 124B, 124C can be formed of polyester material having an adhesive backing. However, other materials are also contemplated. The antenna tapes 120A, 120B, 120C can be formed by attaching the conductive portions 122A, 122B, 122C to the substrate portions 124A, 124B, 124C by any known method. The dimensions, lengths, orientations, shapes, etc. of the conductive portions 122A, 122B, 122C can be configured to optimize antenna performance.

As shown in FIG. 7A, the conductive portion 122A can be formed with a first horizontal portion 126A, an inclined portion 128A, and a second substantially horizontal upper portion 129A to provide the proper transmission characteristics.

An alternative embodiment is shown in FIG. 7B. This embodiment is similar to the embodiment shown in FIG. 7A in that the conductive portion 122B has a first horizontal portion 126B, an inclined portion 128B, and a second substantially horizontal upper portion 129B; however, the conductive portion 122B is formed with a vertical portion 125B formed approximately at a right angle to the first horizontal portion 126B and a top element 127B positioned off of the second substantially horizontal upper portion 129B formed into a circular shape. This antenna-tape design may improve performance of the microphone at lower frequency band transmission.

In the embodiments depicted in FIGS. 7A and 7B, the conductive portions 122A, 122B can be dimensioned 0.100 in. or 2.54 mm in width with the exception of the top element 127B which is formed of a larger diameter. However, it should be noted that other dimensions may also provide the proper performance characteristics of the antenna 100.

In another alternative embodiment shown in FIG. 7C, the conductive portion 122C can be formed with a first conductive element 123C and a second conductive element 125C formed at an incline both following substantially straight lines. The first conductive element 123C and the second conductive element 125C can intersect at the bottom of the antenna tape 120C. The conductive portion 122C is formed with a vertical portion 126C formed approximately at a right angle to the antenna tape 120C near the intersection of the first conductive element 123C and the second conductive element 125C. Two top vertical portions 127C can be formed approximately at right angles to the antenna tape 120C to form a connection between the first conductive element 123C and the second conductive element 125C when the antenna tape 120C is wrapped around the dielectric core 130. Additionally, in an alternative exemplary embodiment, a round top element (not shown) similar to the top element 127B shown in FIG. 7B can be formed near the top of the first conductive element

123C and the second conductive element 125C to form the contact between the two elements.

In an alternative embodiment, the antenna 100 could be formed on a piece of flexible PCB or be formed as part of the PCB 110 and wrapped onto the dielectric core 130 after the PCB 110 is assembled into the chassis 104. In particular, since the conductive portion 122 on the antenna tape 120 is just a trace of specific length and pitch, it could be fabricated as part of the PCB 110. In this embodiment, an adhesive backer could be added to the antenna tape 120 to allow for it to be wrapped onto the dielectric core 130. This would eliminate the solder operations associated with connecting the wire 106 to the PCB 110 and the conductive portion 122 and their associated costs but may add costs due to PCB material utilization.

FIG. 8A illustrates the antenna tape 120A shown in FIG. 7A wrapped around the first cylindrical portion 132 of the dielectric core 130. As shown in FIG. 8, the conductive portion 122A wraps around the dielectric core 130 two and a half times.

FIG. 8B illustrates the antenna tape 120B wrapped around the first cylindrical portion 132 of the dielectric core 130. As shown in FIG. 8B the conductive portion 122B wraps around the dielectric core 130 about two and a half times. Additionally, the vertical portion 125B folds down over the bottom of the dielectric core 130, and the top element 127B folds over the top of the first cylindrical portion 132 of the dielectric core 130.

FIG. 8C illustrates the antenna tape 120C wrapped around the first cylindrical portion 132 of the dielectric core 130. When the antenna tape 120C is wrapped around the dielectric core 130, the first and second elements 123C, 125C form a double helix surrounding the dielectric core 130. The first conductive element 123C and the second conductive element 125C each wrap around the dielectric core 130 about two times. This forms a helical antenna wrapped up the dielectric core 130 corresponding to the first conductive element 123C, then across the top face of the dielectric core 130 via the two top vertical portions 127C, and a second helical wrapping down the dielectric core 130 corresponding to the second conductive element 125C.

In addition, both the first conductive element 123C, which forms an upward helical wrap in a first direction and the second conductive element 125C, which forms a downward helical wrap in the opposite direction will both be terminated on the RF feed from the PCB 110. Both the first conductive element 123C and the second conductive element 125C can be connected to the RF feed on the PCB 110 in operation, which is different than the embodiments shown in FIGS. 7A and 7B because the conductive element 122C is terminated back to the RF feed on the PCB 110. Alternatively, however, in another exemplary embodiment, the second conductive element 125C could be tied to ground instead of the RF feed on the PCB 110.

To assemble the antenna, the dielectric core 130 is wrapped with the antenna tape 120. The PCB 110 is next secured to the L-shaped tab 116 of the chassis 104 by the screw 112. When the ground screw 112 is installed, it compresses an electrically conductive area on the PCB 110 against an electrically conductive area on the L-shaped tab 116 where the paint or finish has been masked, forming an electrical ground connection to provide RF grounding between the PCB 110 and the chassis 104. In order to improve the contact between the PCB 110 and the chassis 104, a solder mask can be removed near the screw hole and a paste can be added to increase the contact area and consistency of the ground reference. The coupling wire 106 or flex cable can then be soldered to the PCB 110 with either a copper pad or a copper-plated through hole on the PCB 110. The wire 106 or flex cable can then be soldered to the conductive portion 122 on the antenna tape 120. Next the dielectric core 130 is inserted into the chassis 104 and the antenna cover 114 is placed over the dielectric core 130. Both the dielectric core 130 and the antenna cover 114 are secured to the chassis 104 by two self-taping screws 140 that are inserted through the antenna cover 114 and into the holes 136 in the second elongated portion 134 of the dielectric core 130.

In an alternative exemplary embodiment, a rigid-flex can be used to extend from the PCB 110 and the end of the rigid-flex can be plated with copper. This plated rigid flex is then soldered directly to the conductive portion of the antenna removing the necessity of the coupling wire 106 and, therefore, eliminates having to solder the coupling wire 106 or flex cable to the antenna 100 and the PCB 110.

The antenna embodiments disclosed herein may achieve a 13% fractional bandwidth over 470-950 MHz with tuning by changing the conductor length while fitting into a small microphone chassis. The embodiments disclosed herein can be implemented in any future handheld wireless device, including but not limited to, devices operating in a similar frequency band that utilize a metal chassis and an antenna cover.

The reader should understand that these specific examples are set forth merely to illustrate examples of the invention, and they should not be construed as limiting the invention. Many variations may be made from the specific structures described above without departing from this invention.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An antenna assembly comprising:

a dielectric core comprising a shock absorbing material, the dielectric core having a first portion and a second portion, the first portion having a circular or elliptical cross section and the second portion having a D-shaped cross section;

antenna tape wrapped around the first portion of the dielectric core, the tape comprising a conductive portion;

a printed circuit board;

a chassis; and wherein the printed circuit board and the conductive portion on the antenna tape are electrically coupled, and the second portion of the dielectric core is configured to be inserted into the chassis.

2. The antenna assembly of claim 1 wherein the dielectric core has an opening in the second portion and the second portion has at least one hole for receiving a fastener to secure the dielectric core to the chassis.

3. The antenna assembly of claim 1 wherein a conductive element electrically couples the printed circuit board and the conductive portion of the antenna tape.

4. The antenna assembly of claim 3 wherein the conductive element comprises a wire that is soldered to both the printed circuit board and the conductive portion of the antenna tape.

5. The antenna assembly of claim 4 wherein the wire is provided with additional length so as to provide slack in the wire.

6. The antenna assembly of claim 1 further comprising an antenna cover positioned over the dielectric core and a shock absorbing member positioned between the dielectric core and the antenna cover.

7. The antenna assembly of claim 1 wherein the printed circuit board mounts to a tab extending from the chassis and wherein a ground element provides electrical contact between the printed circuit board and the tab to ground the antenna.

8. The antenna assembly of claim 7 wherein the ground element comprises a screw.

9. The antenna assembly of claim 7 wherein the dielectric core includes a notch to provide clearance between the ground element and the dielectric core.

10. The antenna assembly of claim 1 wherein the conductive portion comprises a first conductive element and a second conductive element which form a double helix around the dielectric core.

11. The antenna assembly of claim 1 wherein the conductive portion of the antenna tape comprises a circular top element positioned over an end of the dielectric core.

12. The antenna assembly of claim 1 wherein the first portion extends from the chassis and at least a portion of the second portion extends into the chassis.

13. A wireless microphone assembly comprising:

a sound capsule;

a chassis;

an antenna assembly connected to the chassis, the antenna assembly comprising:

a dielectric core comprising a first portion and a second portion;

antenna tape wrapped around the first portion of the dielectric core, the antenna tape comprising a conductive portion; and a printed circuit board electrically coupled to the conductive portion on the tape; and a cover removably connected to the chassis and extending from the chassis and wherein the first portion of the dielectric core is housed within the cover and the second portion of the dielectric core is at least partially housed within the chassis.

14. The wireless microphone assembly of claim 13 wherein the printed circuit board is affixed to a tab extending from the chassis.

15. The wireless microphone assembly of claim 13 wherein the first portion has a circular or elliptical cross section and the second portion has a D-shaped cross section.

16. The wireless microphone assembly of claim 15 wherein the dielectric core has an opening in the second portion and the second portion has at least one hole for receiving a fastener to secure the dielectric core to the chassis.

17. The wireless microphone assembly of claim 13 wherein a conductive element electrically couples the printed circuit board and the conductive portion of the antenna.

18. The wireless microphone assembly of claim 17 wherein the conductive element comprises a wire that is soldered to both the printed circuit board and the conductive portion of the antenna.

19. The wireless microphone assembly of claim 18 wherein the wire is provided with additional length so as to provide slack in the wire.

20. The wireless microphone assembly of claim 13 further comprising a shock absorbing member positioned between the dielectric core and the cover.

21. The wireless microphone assembly of claim 13 wherein the printed circuit board mounts to a tab extending from the chassis and wherein a ground element provides electrical contact between the printed circuit board and the tab.

22. The wireless microphone assembly of claim 21 wherein the ground element comprises a screw.

23. The wireless microphone assembly of claim 21 wherein the dielectric core includes a notch to provide clearance between the ground element and the dielectric core.

24. The wireless microphone assembly of claim 13 wherein the conductive portion comprises a first element and a second element which form a double helix around the dielectric core.

25. The wireless microphone assembly of claim 13 wherein the conductive portion of the antenna comprises a circular top element positioned over an end of the dielectric core.

26. A method for forming an antenna comprising:

providing a chassis and a cover removably connected to the chassis and extending from the chassis;

forming a dielectric core with a first portion and a second portion and wrapping an antenna tape around the dielectric core, the antenna tape comprising a conductive portion;

securing a printed circuit board to a tab at a point located away from the chassis in the axial direction;

electrically coupling the printed circuit board and the conductive portion; and housing the first portion of the dielectric core within the cover and housing the second portion of the dielectric core at least partially within the chassis.

27. The method of claim 26 further comprising forming the dielectric core of a shock absorbing material.

28. The method of claim 26 further comprising securing the dielectric core to the tab with a fastener.

29. The method of claim 26 wherein the antenna tape is wrapped around the first portion of the dielectric core.

30. The method of claim 26 further comprising soldering a conductive element to both the printed circuit board and the conductive portion and securing the printed circuit board with a ground element.

31. The method of claim 26 further comprising forming the conductive portion with a first element and a second element which form a double helix around the dielectric core.

32. The method of claim 26 further comprising forming the conductive portion with a circular top element positioned over an end of the dielectric core.

33. The method of claim 26 further comprising forming the tab L-shaped.

* * * * *